United States Patent [19]

Phillips

[11] Patent Number: 4,962,866

[45] Date of Patent: Oct. 16, 1990

[54] NON-ATTENDED, SELF-SERVICE CUP VENDER

[75] Inventor: Paul A. Phillips, Marietta, Ga.

[73] Assignee: The Coca-Cola Company, Atlanta, Ga.

[21] Appl. No.: 267,052

[22] Filed: Nov. 4, 1988

[51] Int. Cl.[5] ..... G07F 11/00

[52] U.S. Cl. ..... 221/8; 221/96; 222/129.4; 222/132; 364/479

[58] Field of Search ..... 221/96, 15, 129, 194, 221/195, 8, 2, 3; 222/640–643, 129.1–129.4, 132; 364/479

[56] References Cited

U.S. PATENT DOCUMENTS

| | | | |
|---|---|---|---|
| 2,547,423 | 4/1951 | Wegman et al. | 225/21 |
| 3,249,196 | 5/1966 | Maxwell | 194/13 |
| 3,587,918 | 6/1971 | Cornelius | 221/96 |
| 3,685,692 | 8/1972 | Erne et al. | 222/129.4 |
| 4,014,461 | 3/1977 | Harvill | 222/94 |
| 4,275,823 | 6/1981 | Credle, Jr. | 222/94 |
| 4,304,736 | 12/1981 | McMillin et al. | 261/35 |
| 4,517,651 | 5/1985 | Kawasaki et al. | 222/129.4 |
| 4,537,336 | 8/1985 | Verduir et al. | 222/641 |
| 4,573,606 | 3/1986 | Lewis et al. | 221/3 |
| 4,753,370 | 6/1988 | Rudick | 272/129.1 |

FOREIGN PATENT DOCUMENTS

| | | | |
|---|---|---|---|
| 2067311 | 7/1981 | United Kingdom | 364/479 |

*Primary Examiner*—H. Grant Skaggs

*Attorney, Agent, or Firm*—Eduardo M. Carreras; W. Dexter Brooks

[57] ABSTRACT

A non-attended, coin-operated, postmix, cup vender using a cup holder and dropper mechanism, bag-in-box syrup packages, syrup pumps, a conventional counter electric beverage dispenser, a standard ice maker and dispenser and an electronic control to enable the customer to receive a full cup of beverage regardless of the amount of ice selected. The electronic control means also guides the customer through the operation using sequenced lighting displays and messages. The vender includes separate dispense and vend modules.

12 Claims, 8 Drawing Sheets

GENERAL CONTROLS ARRANGEMENT

VENDING CONTROLLER ARRANGEMENT

DISPENSING CONTROLLER WIRING DIAGRAM

DISPENSING CONTROLLER PROGRAM FLOW

FLOW DIAGRAM FOR QUEUE FUNCTION

FLOW DIAGRAM FOR STATUS FUNCTION

DISPENSE FUNCTION FLOW DIAGRAM

DISPLAY FUNCTION FLOW DIAGRAM

NON-ATTENDED, SELF-SERVICE CUP VENDER

BACKGROUND OF THE INVENTION

This invention relates to a high quality, reliable, unattended, coin-operated, postmix, cup vender and in a preferred embodiment to such a vender using bag-in-box syrup packages, syrup pumps, a conventional counter electric beverage dispenser, a standard ice dispenser, and control means to allow the customer to receive a full cup of beverage regardless of the amount of ice selected.

Coin operated, postmix, cup venders are known, however, they have been subject to numerous problems such as a poor quality of dispensed beverages, a lack of reliability, limited choice of cup sizes, and maintenance problems.

SUMMARY OF THE INVENTION

An unattended, coin-operated, postmix, cup vender that dispenses a high quality beverage, is reliable, and is easy to service and maintain. This cup vender: (1) guides the customer through its operation through the use of sequenced lighting displays and messages; (2) delivers cups in up to three different sizes; (3) allows the customer to determine the relative amounts of ice and beverage in the cup; (4) controls the total amount of ice and beverage to equal the amount that will fill the cup purchased by the customer; (5) allows up to five customer transactions to be in the cup vender simultaneously; (6) provides significantly greater capacity to dispense ice and beverage; and (7) provides for proper rotation of syrup inventory.

The cup vender preferably uses bag-in-box syrup packages, syrup pumps, a conventional counter electric beverage dispenser, a standard ice dispenser, and control means for allowing the customer to receive a full cup of beverage regardless of the amount of ice selected.

It is an object of the present invention to provide an unattended cup vender that gives the customer a full cup of beverage regardless of the amount of ice selected.

It is another object of this invention to provide an unattended cup vender that guides the customer through its operation through sequenced lighting displays and messages.

It is another object of this invention to provide an unattended cup vender that will allow up to five customer transactions simultaneously.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENTS

Figure 1:
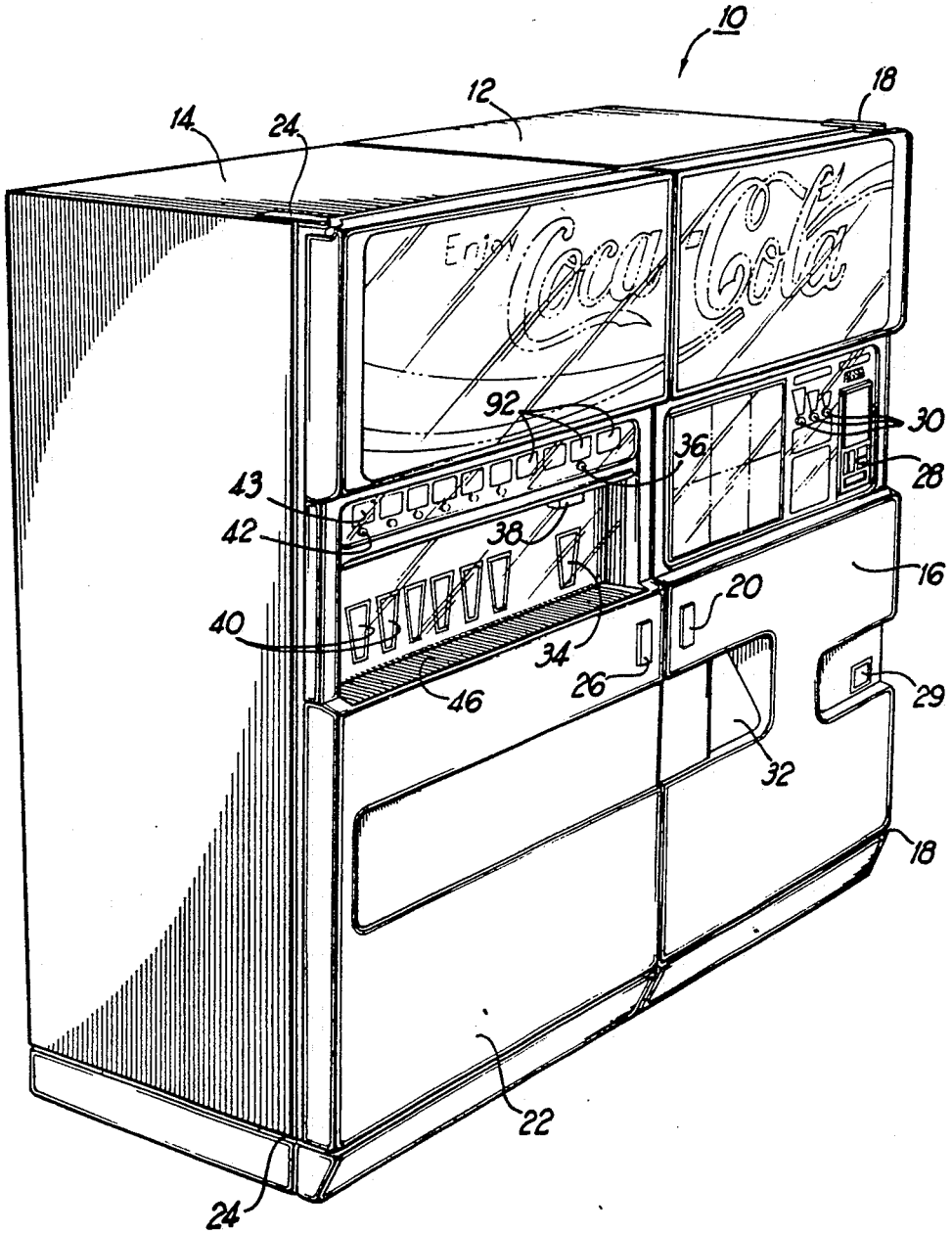
FIG. 1 is a front, top, left side perspective view of the cup vender according to a preferred embodiment of the present invention.
Figure 2:
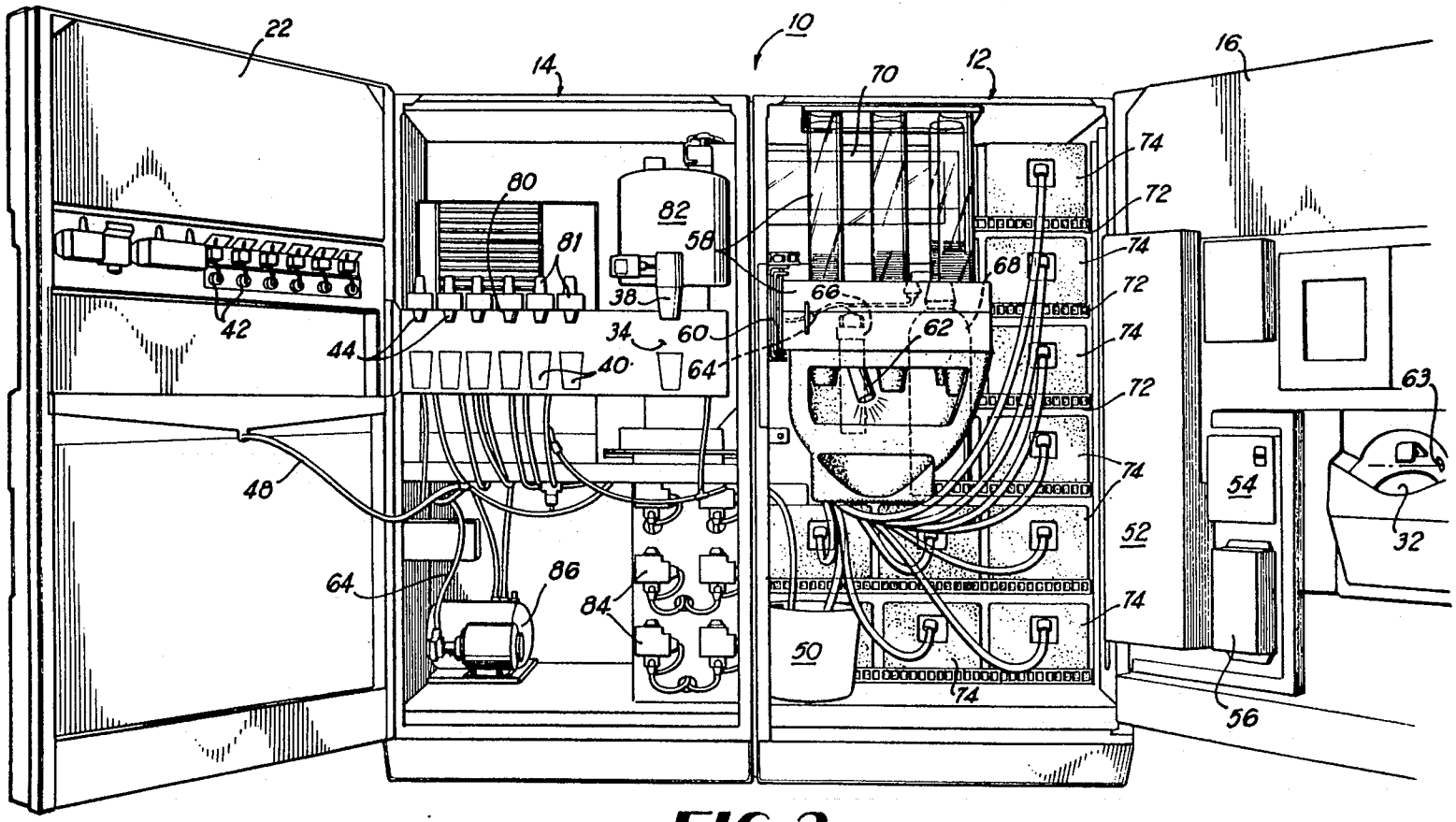
FIG. 2 is a front view of the vender of FIG. 1 with the doors open.
Figure 3:
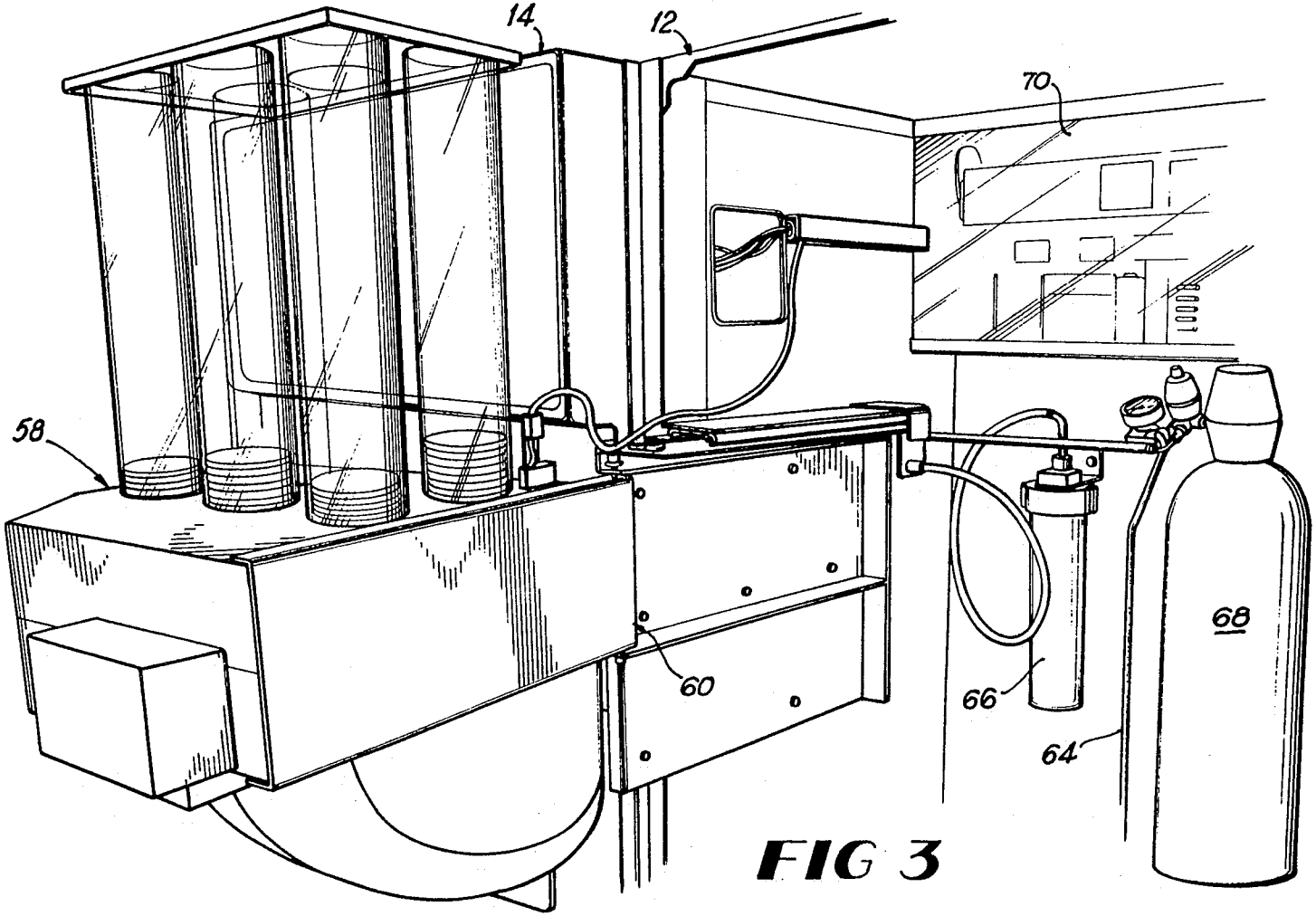
FIG. 3 is a front view of the vending module with the cup holder and dropping mechanism pivoted out of the module.

With reference now to the drawings, FIGS. 1–3 show the non-attended, coin-operated cup vender 10 according to the preferred embodiment of the present invention. The cup vender 10 includes a cup vending module 12 and an ice and beverage dispensing module 14. The module 12 includes a front panel or door 16 hinged at 18 to the remainder of the module and locked thereto by a lock 20. The module 14 includes a front door 22 hinged at 24 to the remainder of the module and locked thereto by a lock 26.

Referring to the cup vending module 12, it includes on the door 16, a coin mechanism 28, a coin return 29, a plurality of cup size selector buttons 30, and a cup vend port 32.

Referring to the door 22 on the dispense module 14, it includes an ice dispense station 34, an ice dispense button 36, an ice chute 38, a plurality of beverage dispensing stations 40 and associated selector buttons 42, flavor indicia panels 43, and nozzles 44. A drip tray 46 is located below the nozzles and a spill tube 48 feeds liquid to a container 50 (located in the vend module).

Referring now to FIG. 2, the vend module 12 includes a coin vault 52 on the rear of the door 16 along with a vend controller 54 and a power supply 56. The vend module houses a cup holder and dropper mechanism 58 supported on a sliding and pivoting support 60 that first pulls out several inches and then pivots the mechanism 58 to the left (as viewed in FIG. 2), to provide access into the module 12. The module 12 also includes a light 62 positioned on the cup mechanism 58 to shine into a cup when dropped into the vend port 32, as sensed by a photoelectric sensor 63 located in a flexible cup stop finger. A water line 64 feeds outside water into a water filter 66 and then to the carbonator 86 in the dispense module. The vend module also holds the $CO_2$ supply tank 68, the electronic controls 70, and the shelves 72 that hold the bag-in-box (BIB) packages 74.

The dispense module 14 holds a standard counter electric beverage dispenser 80 having a plurality of dispensing valves 81 located side-by-side on the front thereof, each including a dispensing nozzle 44, an ice maker and dispenser 82, a plurality of syrup pumps 84 and a carbonator 86. Any known dispenser, ice maker and dispenser, syrup pump and carbonator can be used. The dispenser incorporates standard features such as a refrigeration system for cooling the syrup and water. A vertical plate 87 is positioned in front of the dispenser 80 and ice mechanism 82 and has the cup symbols 40 drawn thereon to identify the various stations.

The cup vender 10 includes a first set of syrup conduits that communicate between the BIB packages and the pumps and a second set that communicate between the pumps and the beverage dispenser.

The cabinet interior of the vender 10 is subdivided into areas for routine refill and areas for mechanical maintenance. This feature allows the operator to only have to open one portion of the cabinet (that is, the vend module 12) for routine use, reducing the service time and complexity. This also allows the operator to restrict certain adjustment functions to qualified persons only, through control of the door access keys, if desired. The routine section of the vender contains storage for the BIB syrup packages, cups, $CO_2$, the coin and bill vault, the drain bucket, the water filter, and a status monitor panel to check on the remainder of the system. All other elements are contained in the maintenance section of the cabinet (the dispense module 14). The interconnection between these two cabinet sections or modules (which are physically separated for shipping) is via quick disconnects.

The cup vender 10 of the present invention is intended to replace the function previously accomplished by a cup vending machine, hereinafter referred to as "CVM." A CVM delivers a finished soft drink beverage to the customer using previously determined amounts of ice and beverage into a previously determined size of beverage cup, in response to the insertion of money or equivalent tender. The cup vender 10 of this invention makes a radical departure from the CVM system in seven areas: (1) it guides the customer through its operation through the use of sequenced lighting displays and messages; (2) it will deliver cups in up to three different sizes; (3) it allows the customer to determine the relative amounts of ice and beverage in the cup; (4) it controls the total amount of ice and beverage to equal the amount that will fill the cup purchased by the customer; (5) it allows up to five customer transactions to be in the cup vender 10 simultaneously; (6) it provides significantly greater capacity to dispense ice and beverage; and (7) it provides for proper rotation of syrup inventory.

DESCRIPTION OF OPERATION

Figure 4:
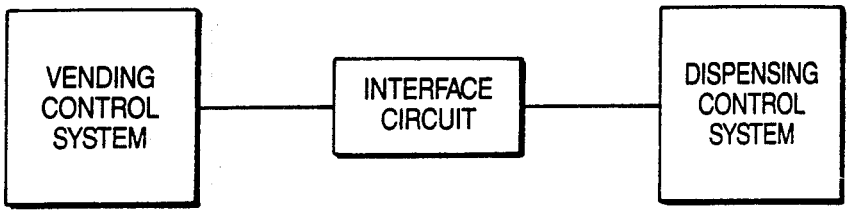
FIG. 4 is a block diagram showing the general controls arrangement.

The cup vender 10 may be considered as having two distinct areas of operation—the sale and vending of an empty cup and an opportunity to fill it (vending), and the filling of said cup with ice and beverage (dispensing). The Interface Circuit of FIG. 4 is provided to connect the control systems of the two operations. Each area of operation is described in detail below.

VENDING OPERATION

Figure 5:
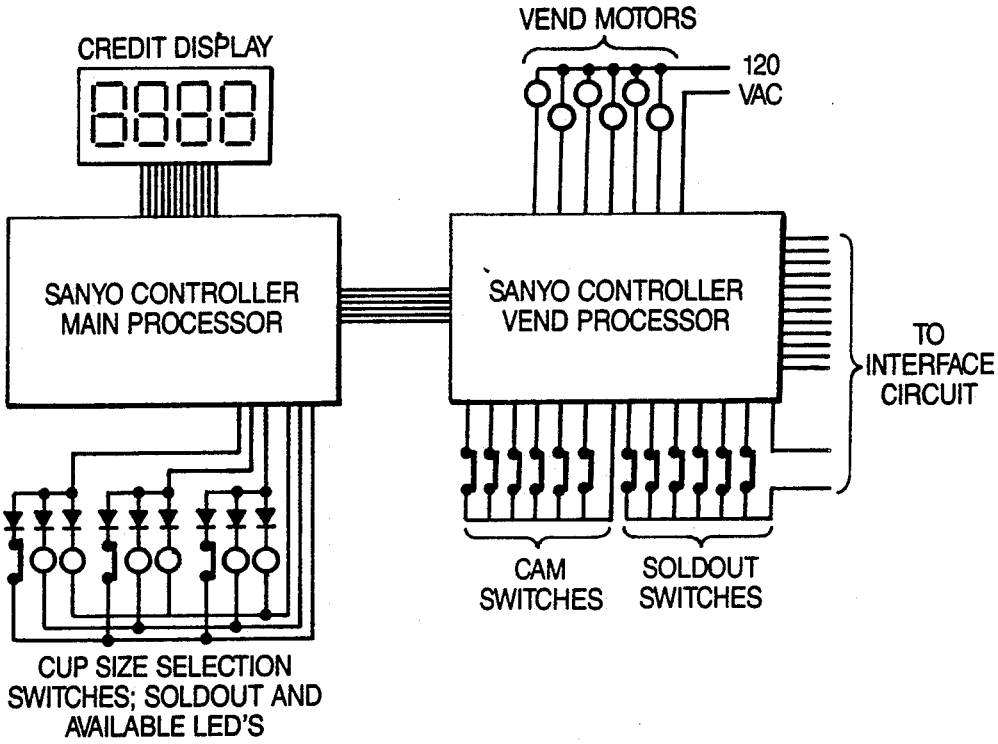
FIG. 5 is a schematic diagram showing the vending control system.

The vending operation employs a means to accept money or other tender, a means to select the size cup desired, a means to vend a cup of the selected size, an electronic control system means and a means to guide the customer through the vending operation. This operation is, for the most part, conventional vending in nature, and utilizes many commercially available components. The commercially available components include the coin mechanism, dollar bill validator, vending electronic control system, electric gearmotor, and cup dispensing mechanism. The vending control system arrangement is shown in FIG. 5.

The operation begins with the customer inserting coins or dollar bills to establish a purchase credit. An electronic display indicates the amount of credit established with the vender 10. As sufficient credit is established to purchase a size of cup, the selection button for the size is illuminated in a flashing pattern by the vending electronic control system. The flashing indication draws the attention of the customer to the next step of operation, the selection of the desired cup size. Pressing the desired cup size selection button causes the vending electronic control system to energize an electric gearmotor which drives the cup dispensing mechanism for the selected size cup, causing the cup to be conveyed to the customer at the cup vend port 32. The vending control system contains the means to electronically relate six cup dispensing mechanisms to the three cup size selections. The vending electronic control system also causes the coin mechanism to return the unused portion of the credit established by the customer, if any. When the cup arrives at the vending port 32, its presence is detected by a photoelectric sensor 63, causing the energizing of the light 62 directed at the vend port from inside the vender 10. This light causes the cup to "glow" in a very unexpected and attention-getting manner, drawing the attention of the customer to its presence.

INTERFACE CIRCUIT

Figure 6:
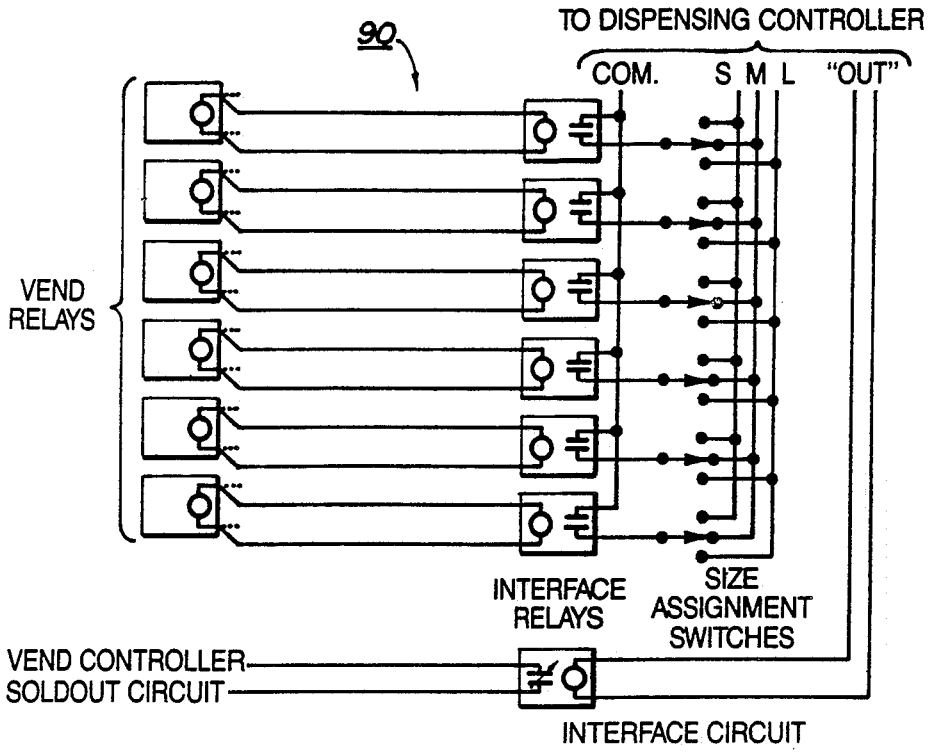
FIG. 6 is a schematic diagram showing the details of the interface circuit.

An interface circuit 90 (see FIG. 6) is provided to exchange information between the vending electronic control system and the dispensing electronic control system. This interface circuit provides the dispensing controller with one of three signals to indicate which size of cup has been vended by the vending controller, and receives a signal from the dispensing controller to indicate the necessity of suspending the vending operation. The details of this circuit are shown in the FIG. 6 schematic diagram, and described below.

The vending system design utilizes six cup dispensing mechanisms, with the ability to install any cup size mechanism at any position. The interface provides six control relays, one operating in parallel with each of the vend relays. Each control relay has associated with it a switch to assign it to one of the three cup sizes. This switch is set to correspond to the size cup dispensed by the associated vend relay-gearmotor-cup dispenser system. The switches are then wired to combine control relay contacts of like size into a single effective contact output for that size.

The dispensing controller generates an output in the event a condition occurs to prevent it from properly dispensing a customer's beverage or continuing operation. The conditions generating this output are dispensing queue full, low water pressure, low $CO_2$ pressure, all syrup supplies out, ice supply out, or waste level high. This output energizes a control relay in the interface circuit, the contact from which interrupts current flow through the soldout sensors for the cup dispensers in the vending controller, creating the effect of all cups out, which will cause the vending controller to cease taking money.

DISPENSING OPERATION

Figure 7:
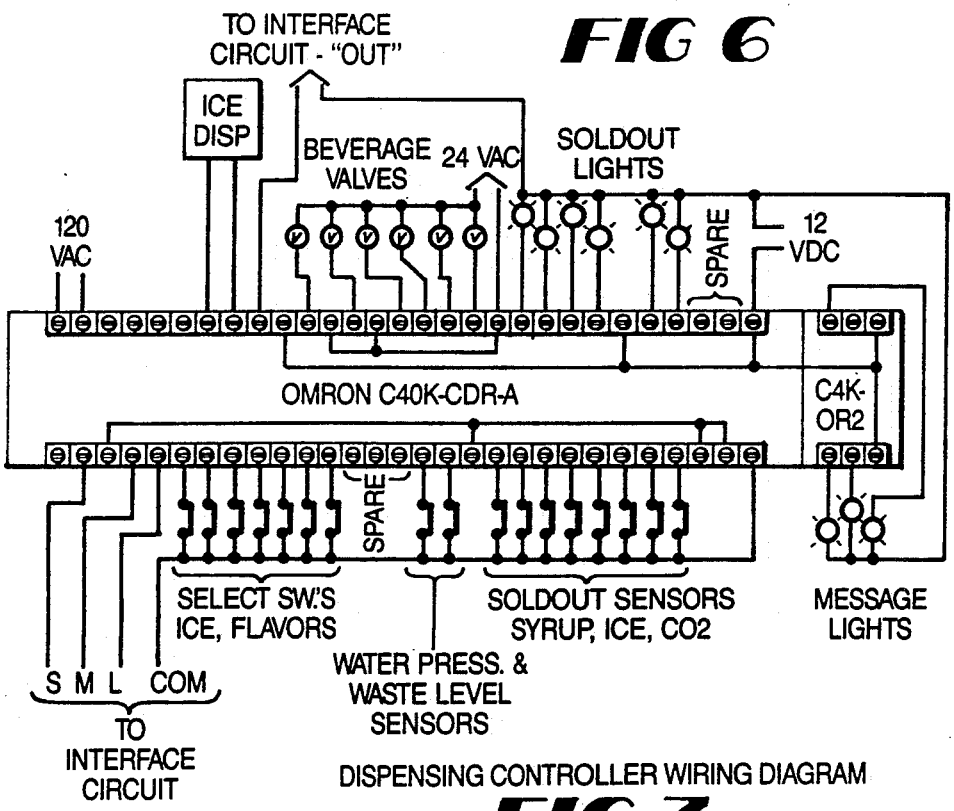
FIG. 7 is a wiring diagram of the dispensing system.
Figure 8:
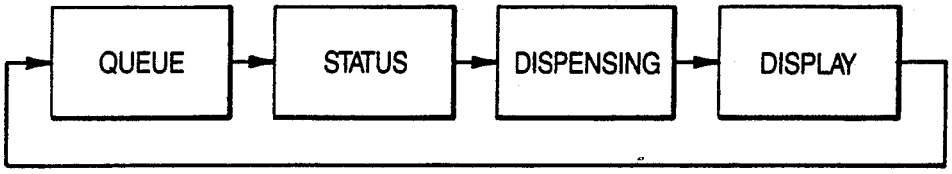
FIG. 8 is a general process flow diagram of the dispensing controller.

The dispensing operation employs the ice maker and dispenser 82, the carbonator 86, the pumps 84, the dispenser 80 to chill and dispense syrup, carbonated water, and plain water, an electronic control system means, and a means to guide the customer through the dispensing operation. Many elements of this operation utilize commercially available equipment. The syrup storage, syrup pumping, carbonation, beverage chilling and programmable control systems are commercially available elements. The dispensing valves and ice dispenser are slight modifications of commercial products, to enable them to be externally controlled. A wiring diagram of the dispensing system is shown in FIG. 7. The general process flow of the dispensing controller is shown in FIG. 8.

Figure 9:
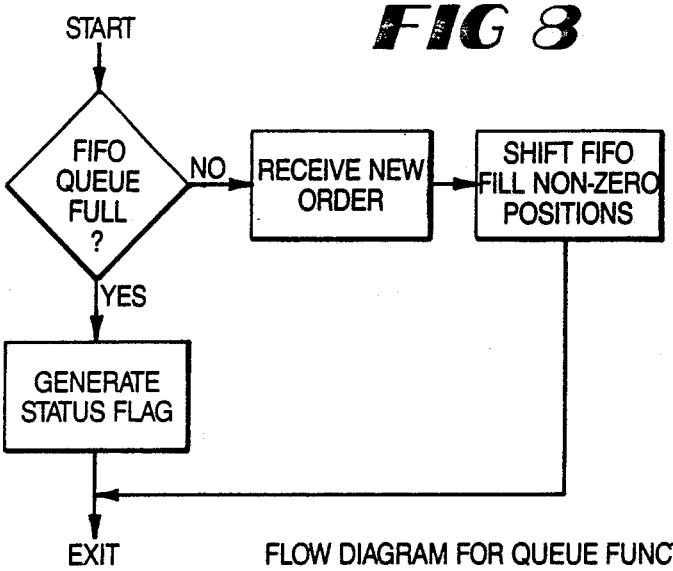
FIG. 9 is a flow diagram for the queue function.

When the dispensing controller receives a signal from the interface circuit that a cup has been vended, it inserts a value into an electronic FIFO queue that corresponds to the volume capacity of the particular cup size. This queue has the capacity to hold the volume reference for five cup vends. The dispensing controller examines the first-in value in the queue for a non-zero value once a program scan, and upon finding one, begins a dispensing sequence, if a sequence is not currently in progress. If a dispensing sequence is in progress, the value is held in the queue until such time as the previous sequence is completed. The flow diagram for the queue is shown in FIG. 9.

Figure 10:
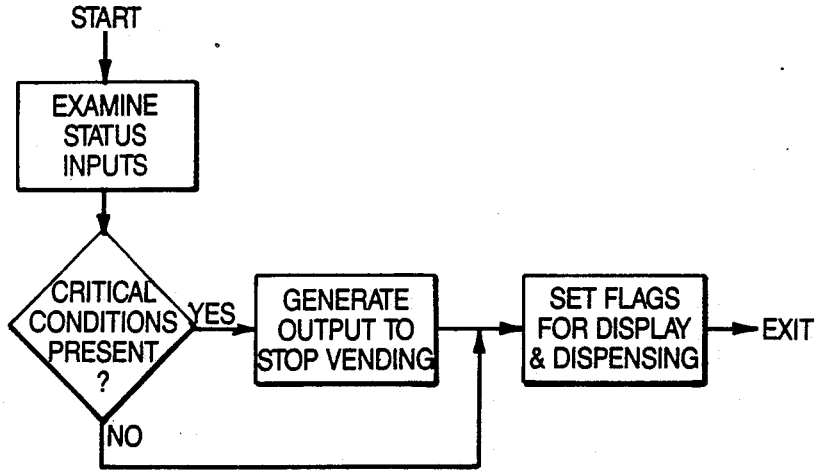
FIG. 10 is a flow diagram for the status function.

The dispensing controller includes a status checking function to monitor the condition of critical machine elements. In the event of a critical status situation, the dispensing controller generates an output to the interface circuit 90, which will cause the vending controller to cease taking money. The critical status items are: low $CO_2$ pressure; low water pressure; high waste bucket level; ice out; all flavors out; or queue full. This function includes time filtering to eliminate false response to stray impulses, such as normal BIB pump operation. Status flags are set for use in the dispensing and display functions. The status function flow is diagrammed in FIG. 10.

Figure 11:
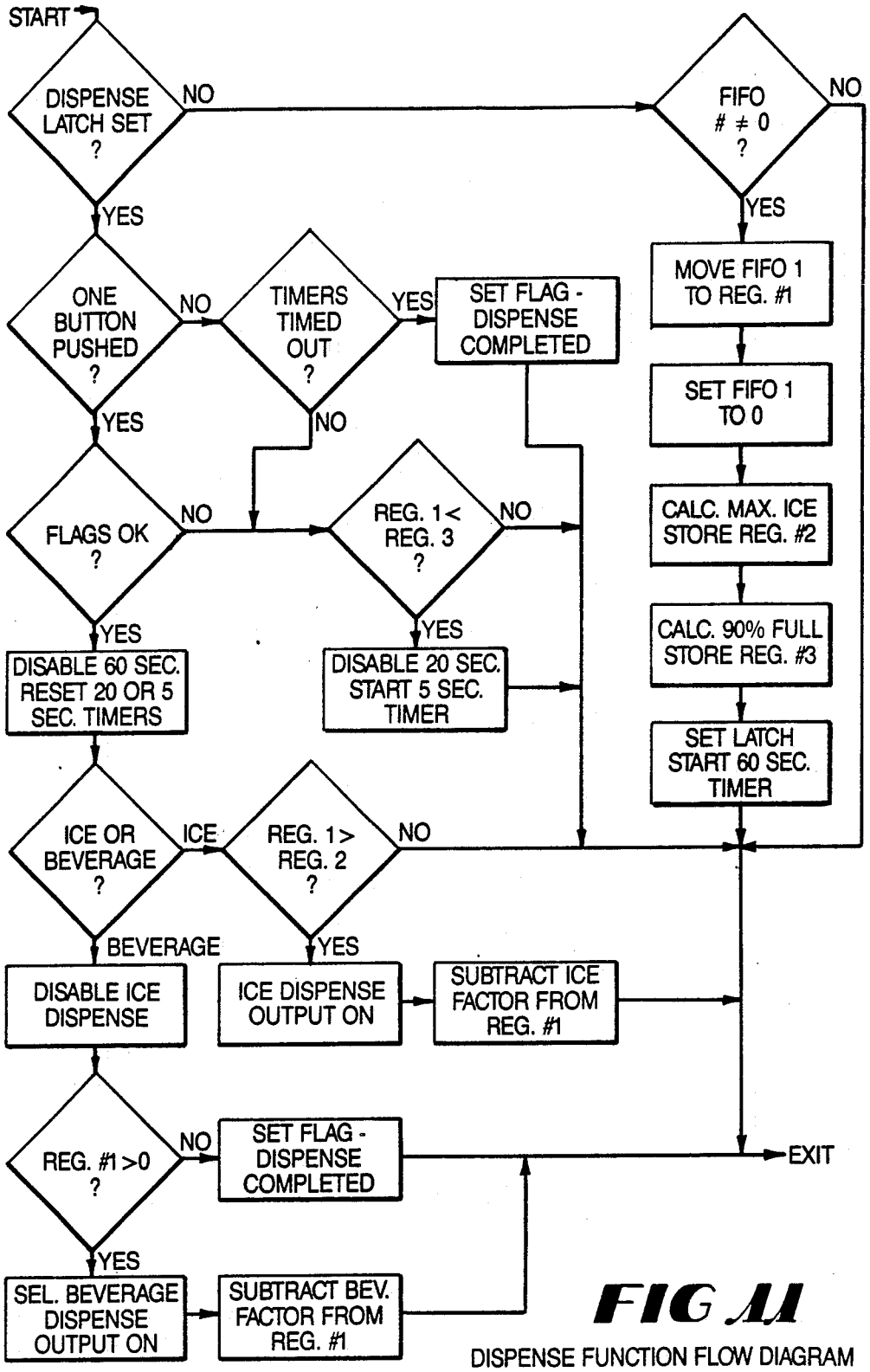
FIG. 11 is a flow diagram for the dispense function.

The dispensing sequence, as shown in the flow diagram in FIG. 11, begins by establishing a latch in the dispensing controller software. The latch is used as a reference that enables dispensing to occur. The latch is reset by the dispensing of the allowed volume or the timeout of one of three reset functions. The volume reference is moved from the queue to a temporary storage register in the controller. Next, the volume reference is divided by a factor that represents the maximum amount of ice the customer is allowed to dispense, and the result is stored in a second storage register. This factor is a function of the density of the ice being dispensed. For the ice used in the vender 10, the ice occupies a space approximately twice the volume of the liquid it would displace—therefore the factor for a full cup of ice is 2. The volume reference is also divided by 10 to establish a reference used for one of the timeout functions, the result being kept in a third storage register.

The three reset functions are provided to reset the vender 10 for subsequent customers in the event a customer does not complete the dispensing operation. The first timing period is started when the dispensing latch function is set on. The purpose of this time period is to allow the customer to collect the cup and any change from the vending portion of the vender, and to begin dispensing ice or beverage. If this first period times out, the dispensing latch is reset, cancelling the transaction, and enabling the next transaction. The first timeout function is disabled once either ice or beverage has been dispensed by the customer. This period is set to 60 seconds in the vender. The second timing period functions between operations of the dispensing process. The timing function begins when either the ice selection button 36 or any beverage selection button 42 is released. It resets when any of these buttons are pressed. The function of the second period is to allow the customer time between dispensing ice and beverage, to top off a beverage, etc., but to reset the vender in the event the customer walks away. The second timing period is effective until 90% of the volume reference is dispensed. This is controlled by comparing the volume left to dispense with the factor in the above reference third storage register. The second timing period is set at 20 seconds in the vender. The third timing period functions in a like manner as the second timing period, except that it is effective from 90% volume dispensed to 100% volume dispensed, and the timing period is shortened to 5 seconds. This time allows a customer to top off a drink, but quickly resets for the next customer if top off does not begin in 5 seconds.

The dispensing controller functions to provide a full finished drink to the customer, and also to prevent the customer from defrauding the operator of the vender. The control program does not permit the simultaneous dispensing of ice and a beverage, or the simultaneous dispensing of two or more beverages. It further restricts the dispensing of ice once the dispensing of beverage has begun. The dispensing controller contains a calculation function that is the key to delivering a full finished beverage of the size purchased, but no more than that volume. This calculation is performed at intervals of 0.1 second any time that either ice or beverage is being dispensed. The calculation is defined by the equation: VOLUME (current)=VOLUME (previous)−FLOW FACTOR (oz./0.1 sec.). Ice dispensing is allowed until VOLUME (current)≦the maximum ice volume from the above referenced second storage register. The VOLUME is stored in the above referenced first storage register, and there is a FLOW FACTOR for ice and each of the beverage flavors in seven additional storage registers. The control program functions to retrieve the appropriate FLOW FACTOR, according to the item being dispensed, at each 0.1 second calculation interval. The control program allows the customer to freely choose the amount of ice (up to the preset limit) and to dispense either one or several beverage flavors (but not simultaneously) into the cup purchased. The control program allows dispensing to continue until the value VOLUME (current)≦0. At that time, no further dispensing is allowed for the current transaction. The control program begins a delay time to allow the current customer to move out of the way, then resets the dispensing latch function. This delay is set at 5 seconds in the vender.

Figure 12:
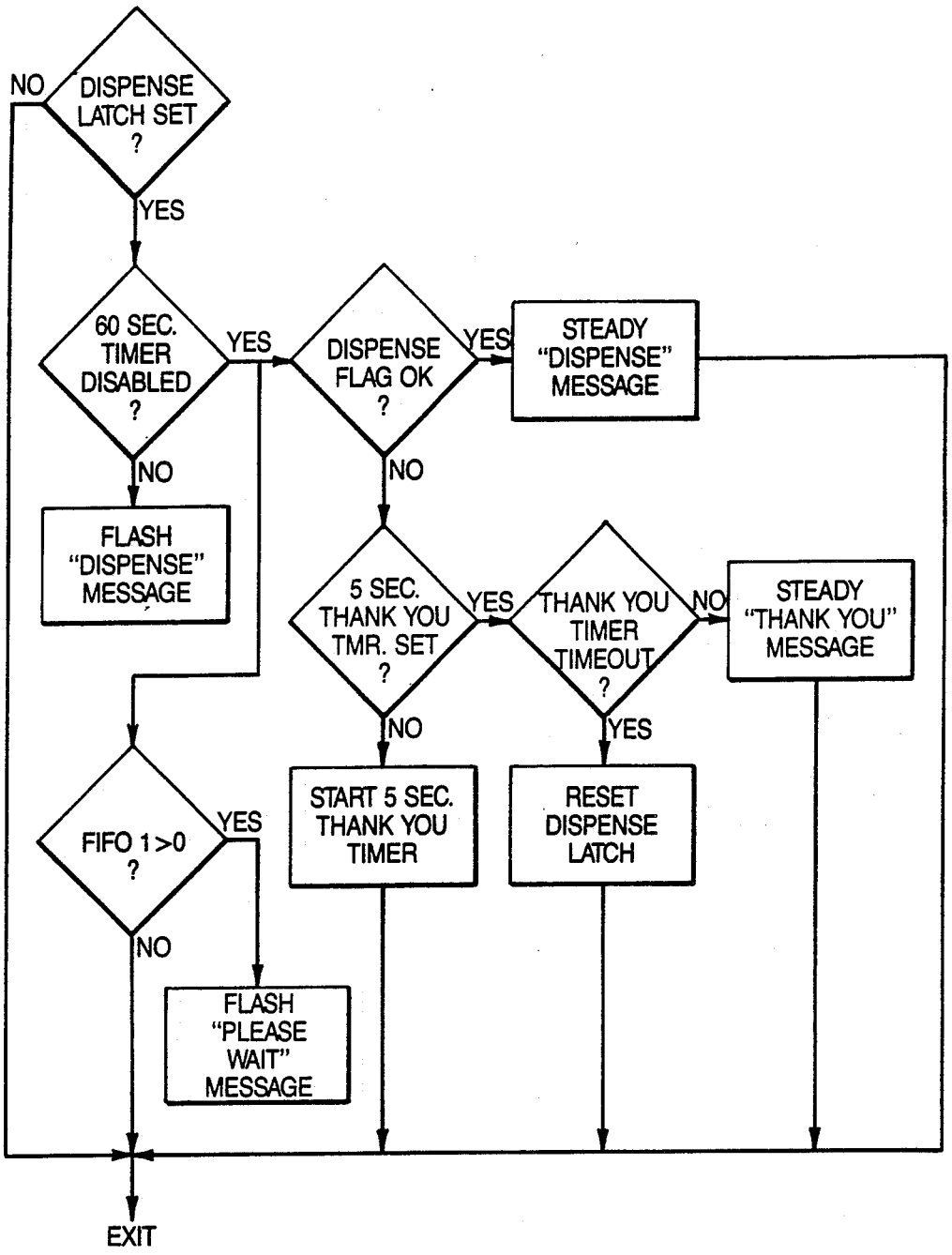
FIG. 12 is a flow diagram for the display function.

The vender provides three message functions driven by the dispensing controller to aid the customer in operation of the vender. These messages are "Dispense Ice and Beverage", "Please Wait", and "Thank You", and are presented in panels 92 located on the door 22 adjacent to the dispensing buttons 42 and flavor identification panels 43. The operation of these messages is as follows. "Dispense Ice and Beverage" is activated when the dispensing latch is set. It is illuminated in a flashing pattern until the customer begins the dispensing process by pressing either the ice button 36 or one of the flavor buttons 42. At that time, "Dispense Ice and Beverage" turns to a steady illumination. It remains on until the dispensing is completed, as defined by the factor VOLUME having a value≦0, or until one of the three reset timeouts occur. The message "Please Wait" is activated when a second customer vends a cup while a first customer is still dispensing a drink. When "Please Wait" is active, it is illuminated in a flashing pattern. Should the first customer not yet have begun dispensing, indicated by a flashing "Dispense Ice and Beverage" message, the "Please Wait" message is held inactive until said first customer begins dispensing. The "Thank You" message is illuminated during the 5 second delay period between the completion of dispensing and the reset of the dispensing latch by the control program. It is illuminated steady when active. Refer to FIG. 12 of the flow diagram of the display function.

While the preferred embodiment of this invention has been described above in detail, it is to be understood that variations and modifications can be made therein without departing from the spirit and scope of the present invention. For example, while a plurality of beverage dispensing valves is shown, one for each different beverage, one or more multiflavor valves can be used in place of the individual valves. Also, while bag-in-box packages are shown, other syrup packages can be used. A separate carbonator has been shown, however, this can be dispensed if a beverage dispenser 80 of the type with a built-in carbonator is used. Although the cup vender 10 preferably is made up of two different modules, this is not essential. Different types of cup holders and droppers can also be used. The choice of distinct control systems for the vending and the dispensing operations represented a choice of expediency for the prototype, to avoid time delay in controls development; later versions will probably employ a single control system for both functions. Debit cards and tokens can be used instead of or in addition to money. Smaller BIB packages (than the five gallon size shown) can be used, if available, to reduce cabinet size. Different cup vend ports can be used for different cup sizes, if desired. More than three cup sizes can be used, if desired.

What is claimed is:

1. In a beverage cup vender having a housing and a coin mechanism in said housing for initiating the dispensing cycle; the improvement comprising:

(a) a plurality of separate consumer activated stations comprising:

(1) a cup size selection station, including means for selecting the cup size to be vended, said means providing a first output signal;

(2) a cup drop station including a vending port in a front panel of said housing;

(3) an ice dispensing station including means for dispensing an amount of ice to be determined by a consumer into a cup placed by the consumer at said ice dispensing station, said ice dispensing station being separate from and disposed adjacent to said cup drop station, said means for dispensing ice providing a second output signal;

(4) a beverage dispensing station, separate from and disposed adjacent to said ice dispense station, said beverage dispensing station including means responsive to a selection button operated by the consumer for dispensing a selected beverage;

(b) an electronic controller mounted in said housing for controlling the beverage dispensing operation of said cup vender, said controller including means, responsive to said first and second output signals, for limiting the amount of beverage dispensed by the means for dispensing a selected beverage, whereby the total volume of ice and beverage dispensed approximates the volume of the cup selected by the consumer; and (c) means coupled to and responsive to said electronic controller for guiding the consumer to the next of said stations to be operated by the consumer.

2. The improvement as recited in claim 1 wherein said means for guiding includes means for guiding a plurality of consumers through said stations in an orderly sequence.

3. The improvement as recited in claim 1 wherein said means for guiding the consumer includes a first means, responsive to the coin mechanism and electronic controller, for leading the consumer to the cup size selection station by indicating the cup size that the consumer can purchase when sufficient credit for such purchase is deposited in the coin mechanism.

4. The improvement as recited in claim 3 wherein said means for selecting a cup size to be vended comprises a plurality of cup size selection buttons, each representative of a cup size, and wherein said first means for leading comprises means for illuminating the cup size selection button when sufficient credit for the purchase of the size cup represented by that cup size selection button has been deposited in the coin mechanism.

5. The improvement as recited in claim 1 wherein said means for guiding the consumer includes a second means, responsive to the output from the means for selecting the cup size to be vended, for leading the consumer to the cup drop station by illuminating the cup dispensed in the vending port.

6. The improvement as recited in claim 1 wherein said means for guiding the consumer includes a third means for leading the consumer to the ice dispensing station or the beverage dispensing station.

7. The improvement as recited in claim 6 wherein said third means for leading comprises the display of a message to the consumer.

8. A method for vending a postmix beverage comprising the steps of:

(a) providing a non-attended, postmix cup vender including a coin mechanism, and a plurality of discrete stations comprising a cup size selection station, a cup drop station, and ice dispensing station, and a beverage dispensing station;

(b) guiding a consumer through each one of said plurality of stations;

(c) enabling the consumer to select one of a plurality of cup sizes at the cup size selection station;

(d) enabling the consumer to dispense the amount of ice desired by the consumer and;

(e) enabling the consumer to dispense a volume of beverage approximately equal to the difference between the volume of the cup size selected by the consumer and the volume of ice dispensed by the consumer.

9. The method as recited in claim 8 wherein said step of guiding a customer through said plurality of stations comprises sequentially lighting a plurality of displays and messages.

10. The method as recited in claim 8 wherein said guiding step includes guiding a plurality of consumers simultaneously.

11. The method as recited in claim 8 wherein said guiding steps comprise:

(a) indicating in the cup size selection station when sufficient credit has been established to vend a cup of a certain size;

(b) illuminating a vended cup at the cup drop station when the consumer has selected the size of cup to be vended; and (c) directing the consumer to the ice dispensing station and the beverage dispensing station.

12. The method of claim 11 wherein said directing step comprises displaying a message.

* * * * *